US009190255B2

(12) United States Patent
Raptakis et al.

(10) Patent No.: US 9,190,255 B2
(45) Date of Patent: Nov. 17, 2015

(54) CONTROL OF IONS

(75) Inventors: Emmanuel Raptakis, Attika (GR); Dimitris Papanastasiou, Attika (GR)

(73) Assignee: Fasmatech Science and Technology LLC, Afidnes, Attika (GR)

( * ) Notice: Subject to any disclaimer, the term of this patent is extended or adjusted under 35 U.S.C. 154(b) by 0 days.

(21) Appl. No.: 13/699,721

(22) PCT Filed: May 23, 2011

(86) PCT No.: PCT/IB2011/052244
§ 371 (c)(1),
(2), (4) Date: Nov. 24, 2012

(87) PCT Pub. No.: WO2011/148312
PCT Pub. Date: Dec. 1, 2011

(65) Prior Publication Data

US 2013/0068944 A1 Mar. 21, 2013

(30) Foreign Application Priority Data

May 24, 2010 (GB) ..... 1008609.8

(51) Int. Cl.
*H01J 49/40* (2006.01)
*H01J 49/06* (2006.01)
(Continued)

(52) U.S. Cl.
CPC ..... *H01J 49/067* (2013.01); *H01J 49/40* (2013.01); *H01J 49/34* (2013.01); *H01J 49/426* (2013.01)

(58) Field of Classification Search
CPC ..... H01J 49/40; H01J 37/05; H01J 29/84
USPC ..... 250/396 R
See application file for complete search history.

(56) References Cited

U.S. PATENT DOCUMENTS 5,747,801 A * 5/1998 Quarmby et al. ..... 250/292
2004/0232327 A1* 11/2004 Bateman et al. ..... 250/288
(Continued)

FOREIGN PATENT DOCUMENTS

GB 2378312 2/2003
WO WO 2005114703 A2 * 12/2005

OTHER PUBLICATIONS

Practical Aspects of Trapped Ion Mass Spectrometry, vol. IV, Theory and Instrumentation, Ed. R.E. Mar. & J.F.J. Todd, CRC Press, 2010. Jan. 1, 2010.

(Continued)

*Primary Examiner* — Jack Berman
*Assistant Examiner* — James Choi
(74) *Attorney, Agent, or Firm* — Hodgson Russ LLP

(57) ABSTRACT

A mass spectrometer comprises ion pulse means for producing ion pulses in a first vacuum chamber, ion trap means for receiving and trapping the ion pulses for mass analysis in a second vacuum chamber, and ion-optical lens means arranged between the ion pulse means and the ion trap means for receiving the ion pulses and outputting ions therefrom to the ion trap means. A first lens electrode and a second lens electrode collectively define an optical axis and are adapted for distributing a first electrical potential and second electrical potential therealong. Lens control means vary non-periodically with time the first electrical potential relative to the second electrical potential to control as a function of ion mass-to-charge ratio the kinetic energy of ions which have traversed the ion optical lens means. This controls the mass range of the ions receivable by the ion trap from the ion optical lens means.

32 Claims, 6 Drawing Sheets

(51) Int. Cl.
*H01J 49/34* (2006.01)
*H01J 49/42* (2006.01)

(56) References Cited

U.S. PATENT DOCUMENTS

| | | | | |
|---|---|---|---|---|
| 2007/0029473 | A1* | 2/2007 | Verentchikov | 250/281 |
| 2009/0045334 | A1* | 2/2009 | Ding | 250/288 |
| 2010/0032561 | A1* | 2/2010 | Giles et al. | 250/283 |
| 2010/0193681 | A1* | 8/2010 | Vestal | 250/287 |
| 2013/0056629 | A1* | 3/2013 | Bateman et al. | 250/282 |
| 2014/0131567 | A1* | 5/2014 | Makarov | 250/283 |

OTHER PUBLICATIONS

W.C. Wiley & I.H. McLaren, Rev. Sci. Instrum., 1955, 26, 1150. Jan. 1, 1955.
Kovtoun SV, Rapid Commun. Mass Spectrom. 1997, 11, 810. Jan. 1, 1997.
Time-of-Flight Mass Spectrometry: Instrumentation and Applications in Biological Research. R.J. Cotter, ACS, 1997. Jan. 1, 1997.
K.A. Cox et al., Bio. Mass Spectrom. 21, 226, 1992. Jan. 1, 1992.
V.D. Doroshenko et al., Rapid Commun. Mass Spectrom. 6, 753, 1992. Jan. 1, 1992.
K. Jonscher et al., Rapid Commun. Mass Spectrom. 7, 20, 1993. Jan. 1, 1993.
J.C. Schwartz et al., Rapid Commun. Mass Spectrom. 7, 27, 1993. Jan. 1, 1993.
J. Qin & B.T. Chait, J. Am. Chem. Soc. 117, 5411, 1995. Jan. 1, 1995.
R.L. Hettich & M.V. Buchanan, J. Am. Soc Mass Spectrom. 2, 22, 1991. Jan. 1, 1991.
T. Solouki & D.H. Russel, Proc. Natl. Acad. Sci. USA 89, 5701, 1992. Jan. 1, 1992.
Hofstadler SA, Lauder DA, Int. J. Mass Spectrom. Ion Process. 1990, 101, 65. Jan. 1, 1990.
Castro JA et al., Rapid Commun. Mass Spectrom. 1992, 6, 239. Jan. 1, 1992.
Hofstadler SA et al., Anal. Chem. 1993, 65, 312-316. Jan. 1, 1993.
Ding L. et al., Proc. SPIEE—Int. Soc. Opt. Eng. 1999, 3777, 144. Jan. 1, 1999.
Papanastasiou D. et al., Rev. Sci. Instrum. 2008, 79, 055103. Jan. 1, 2008.
Makarov A., Anal. Chem. 2000, 72, 1156. Jan. 1, 2000.
Lebrilla CB et al., Int. J. Mass. Spectrom. Ion Process. 1989, 87, R7-R13. Jan. 1, 1989.
A.G. Marshall et al., Mass Spectrom., Rev. 17, 1-35, 1998. Jan. 1, 1998.
Hu Q. et al., J. Mass Spectrom. 2005, 40, 430. Jan. 1, 2005.

* cited by examiner

CONTROL OF IONS

The present invention relates to means and methods for controlling ions in ion beams, such as beams generated from pulses of ions. Particularly, though not exclusively, the invention relates to ion-optical lenses and their operation for use in conjunction with ion trapping devices.

The rapid expansion of the use of ion traps in modern mass spectrometry and the diverse areas of application are indicative of the critical role of this unique technique of mass analysis in the field of analytical and bioanalytical sciences. The extensive family of tandem and hybrid instruments available today has established the versatility of ion trapping devices. The fundamentals and operational aspects of ion traps have been described [Practical Aspects of Trapped Ion Mass Spectrometry, Volume IV, Theory and Instrumentation, Ed. R. E. March & J. F. J. Todd, CRC Press, 2010; A. G. Marshall et al, Mass Spectrom. Rev. 17, 1-35, 1998].

The successful coupling of a trapping device with ionization sources or other devices acting as sources of ions such as RF ion traps is essential for sensitive mass analysis. Injection of ions formed externally to an ion trap is a challenging task and a central feature for evaluating the performance of this type of instruments. Problems associated with the injection process are specific to each of the various types of trapping devices employed since the initial distribution of ions in phase space required for successful trapping can differ considerably.

The development of soft laser ionization and in particular the progression of the Matrix-Assisted Laser Desorption Ionization (MALDI) has extended the use of mass spectrometry. Laser desorption/ionization is a unique technique for introducing intact molecular ions in the gas phase. One of the key features of MALDI is the initial phase space distribution during the first steps of the desorption/ionization process. Ions formed by MALDI acquire a common velocity distribution determined by the velocity of the matrix material in the exploding plume. As a consequence, the kinetic energy of ions scales linearly with mass-to-charge (m/z) ratio. The magnitude of the initial ion velocity is mainly determined by the matrix employed and also the sample preparation. Controlling the initial ion kinetic energy is essential for the performance of any mass analyzer coupled to the MALDI source.

LDI and MALDI were first realized using time-of-flight (TOF) mass analyzers, mainly because TOF is compatible with the pulsed nature of lasers and capable of performing high mass measurements. LDI and MALDI sources were developed in parallel with a special class of TOF mass spectrometers, designed in particular to address the issue of the wide initial velocity spread. Extension of the time-lag focusing technique [W. C. Wiley & I. H. McLaren, *Rev. Sci. Instrum.*, 1955, 26, 1150] in MALDI TOF mass spectrometry (MS), known as delayed extraction, was essential for enhancing the mass resolving power of this particular family of instruments. In delayed extraction, a square voltage pulse is delivered to a lens electrode for ejection of ions into the TOF mass analyzer at the end of a predetermined time interval. During this time-lag ions are allowed to expand freely and rearrange their position according to their initial ion velocities. Faster moving ions travel longer distances and fall through a smaller potential difference during extraction. A time focus is then generated since position and velocity are correlated. Despite this advancement, the technique was only capable of focusing a single mass-to-charge on the detector. More elaborate time-dependent signals have been implemented to improve the time-focusing properties in TOF MS over a wider range of m/z [Kovtoun S V, *Rapid Commun. Mass Spectrom.* 1997, 11, 810; U.S. Pat. No. 6,518,568 B1; U.S. Pat. No. 5,969,348; GB 2,317,048]. Special types of reflectrons have also been developed to accommodate the wide kinetic energy spread of the MALDI source [Time-of-Flight Mass Spectrometry: Instrumentation and Applications in Biological Research. R. J. Cotter, ACS, 1997].

Despite the success of TOF as a suitable mass analyzer for laser/desorption ionization experiments, ion trapping devices exhibit their own figures of merit; however, the successful coupling of vacuum MALDI to ion traps, similar to the case of TOF, has proved a rather difficult task. Direct injection of MALDI ions in trapping device is hindered, in part, due to the unimolecular decomposition of the thermally labile molecular ions, which become noticeable due to the extended analysis time required for trapping devices compared to TOF to generate a spectrum, and, in part, due to the high initial velocity and also velocity spread and, consequently, the reduced trapping efficiency especially for the greater m/z ratios. These characteristics impose decisive technical challenges to the development of this type of instruments. Nevertheless, the advantage of performing tandem-in-time mass analysis in a RF ion trap favors this particular type of mass analyzer over TOF, which requires an additional stage for each step of mass analysis. Furthermore, the superior mass resolving power exhibited in Fourier-Transform ion trap mass spectrometry is a significant advantage.

In the early stages of LDI ion trap instrument development, high-vacuum electrostatic fields were used extensively for transporting laser produced ions to the mass analyzer despite the limited mass range injected successfully and consequently the reduced sensitivity [K. A. Cox et al, Biol. Mass Spectrom. 21, 226, 1992; V. D. Doroshenko et al, Rapid Commun. Mass Spectrom. 6, 753, 1992; K. Jonscher et al, Rapid Commun. Mass Spectrom. 7, 20, 1993; J. C. Schwartz et al, Rapid Commun. Mass Spectrom. 7, 27, 1993; J. Qin & B. T. Chait, J. Am. Chem. Soc. 117, 5411, 1995]. The common velocity distribution and the associated disadvantage related to wide mass range trapping was encountered in the early studies coupling MALDI sources to Fourier Transform Ion Cyclotron Resonance (FT ICR). The shallow axial potential well in ICR cells was a critical limitation for storing the heavier ions having greater kinetic energies, effectively restricting wide mass range trapping [R. L. Hettich & M. V. Buchanan, J. Am. Soc Mass Spectrom. 2, 22, 1991]. Pulsed gas introduction proved a rather successful approach in removing the excess kinetic energy of the laser produced ions via collisions with the buffer gas and also satisfied the high vacuum requirement during ion detection [T. Solouki & D. H. Russel, Proc. Natl. Acad. Sci. USA 89, 5701, 1992]. Nevertheless, the time required for the pulsed gas to pump out of the system was prohibitively long.

Methods for axial injection of externally generated ions in ICR cells were introduced in the early stages of vacuum MALDI FT ICR development. The "gated trapping" method for axial injection [Hofstadler S A, Lauder D A, *Int J Mass Spectrom Ion Process.* 1990, 101, 65] employs a decelerating potential applied to the rear trap electrode of the cell to slow down heavier ions having greater kinetic energies. After a predetermined time window, the trap electrodes of the cell are switched to the trapping mode. A modification of this technique was presented [Castoro J A et al, *Rapid Commun Mass Spectrom.* 1992, 6, 239] where a greater deceleration potential of 9.0 V applied to the rear trap plate of the ICR cell was used during ion injection, while the front trap plate was maintained at 0 V. Ions with energies above 9 eV were lost. Wide mass range trapping in FT ICR was demonstrated for the first time, however, the disadvantage of this approach is that lighter ions are reflected and ejected out of the trap while heavier ions are still being introduced into the cell. In practice the mass range introduced efficiently is limited by the residence time of the lighter ions in the cell. In addition, the low and high mass side of the injected species are trapped with poor efficiency.

Improved trapping efficiency of MALDI produced ions in FT ICR is also possible by narrowing the kinetic energy spread of the ions in the acceleration region of the ionization source [U.S. Pat. No. 6,130,426]. In the method disclosed, the potential applied to the plate carrying the sample is varied prior to the application of the extraction voltage pulse to reduce the ion kinetic energy spread. Although the final kinetic energy spread for each mass-to-charge ratio can be reduced, the trapping efficiency remains hampered by differences in the kinetic energy between ions with different m/z ratios.

In another embodiment of the prior art a method known as the "kinetic energy band pass filter" has been proposed to control such variations in the kinetic energy of ions across the mass range and enhance trapping efficiency in ICR cells [Hofstadler S A et al, *Anal. Chem.* 1993, 65, 312-316; Lebrilla C B et al, *Int J Mass Spectrom Ion Process.* 1989, 87, R7-R13]. This method demonstrates that optimum trapping for a particular m/z ratio is achieved only by precise control of the kinetic energy, and that ions having different kinetic energies require different potentials to be retained in the cell. Obviously, the electrostatic fields employed prior to the trap can only account for a narrow m/z ratio and scanning is required to optimize injection across the entire mass range.

The characteristic features of the trapping device employed for storing ions and performing mass analysis determines the method developed to enhance trapping efficiency to a great extend. In yet another embodiment of the prior art periodic time-varying voltages are applied to lens electrodes disposed adjacent to the introduction end-cap of a quadrupole ion trap [U.S. Pat. No. 5,747,801]. The periodic time-varying voltage is intended to correct for the fringe fields surrounding the entrance to the QIT and, therefore, minimize the scattering ions experience upon their injection. Despite the improvement in the injection efficiency demonstrated by simulations, the method is shown to be highly dependent on the kinetic energy of incoming ions and the RF phase of the AC waveform. Here again, efficient trapping over a wide range of mass-to-charge ratios is not possible, in part, due to scattering by the RF fringe fields surrounding the entrance to the trap, and in part, due to the mismatch between ion kinetic energy and RF phase for the different ratios of m/z.

In yet another embodiment of the prior art, high-vacuum MALDI produced ions were injected in a quadrupole ion trap through a series of rotationally symmetric ring electrodes and appropriate potentials comprising two successive Einzel lenses [Ding L. et al, Proc. SPIEE—Int. Soc. Opt. Eng. 1999, 3777, 144]. Following injection into the QIT, lighter ions are reflected by an electrostatic potential applied to the end-cap electrodes while the heavier ions are still being introduced. The RF-drive of the trap is switched-on after the maximum range of m/z ratios is introduced into the trapping volume, determined by the residence time of the lowest m/z ratio before being ejected by the temporary reflectron field, and the upper m/z entering through the end-cap hole at the end of this time interval. Despite eliminating the scattering ions experience by the RF field upon ion introduction, the mass range stored in the trap is limited by differences in the arrival times of the ions. For this particular configuration, an additional factor limiting trapping efficiency is the excess kinetic energy of the heavier ions, which increases the angular divergence of the ion beam, and cannot be corrected when electrostatic fields are employed.

All techniques discussed so far to inject ions in ion traps can control injection efficiency over a particular mass range or, over a particular kinetic energy range only. In addition, the injection efficiency for the low- and high-mass side of the mass range introduced into the trap is generally poor.

The standard approach to enhancing trapping efficiency in an orbitrap is to gradually increase the magnitude of a voltage applied inside the trap to the inner trap electrode to force injected ions within the trap into stable trajectories, a method such as this, termed "electrodynamic squeezing", is described in U.S. Pat. No. 5,886,346. A significant disadvantage of this approach is that for a monoenergetic ion beam, the heavier ions arriving into the ion trap at later times experience a stronger trapping field within the trap and cannot be retained in the trap due to the lower kinetic energy they posses. Efficient trapping over a wide mass range requires providing the heavier ions with sufficient energy to obtain stable trajectories in the orbitrap.

External injection of MALDI ions in a QIT is shown to be limited by the angular divergence of the ion beam [Papanastasiou D. et al, *Rev. Sci. Instrum.* 2008, 79, 055103]. The sensitivity of this method is compromised by the wide energy spread of the heavier ions, which require sufficiently stronger lenses to achieve a tightly focused ion beam to pass through the narrow entrance hole of the introduction end-cap. For these heavier ions, with greater kinetic energies, the position focus of an electrostatic lens is projected to significantly greater distances compared to that of lighter ions with smaller kinetic energies. An undesirable dispersion of focal lengths is produced as a result.

The invention aims to provide improvements relating to the control of ions which may be used to address limitations in the prior art.

It is a preferred aim of the invention to provide an electrodynamic lens which is compatible with ion traps, such as those discussed above for example, to control ion kinetic energy as a function of ion mass-to-charge (m/z) ratio, preferably across the entire mass range of interest and preferably thereby enhance ion trapping efficiency and sensitivity.

Furthermore, it is a preferred aim of the present invention to provide methods for generating time-dependent electrical potentials in an ion-optical lens to control the kinetic energy of ions in preparation for entering a trapping device. The invention preferably exploits the fact that an ion-optical lens system may act as short time-of-flight system where ions with different m/z ratios traverse the lens at different times. It is therefore possible to vary the potential generated in at least one lens electrode of an ion-optical lens to alter the kinetic energy progressively, preferably across the entire mass range transported through the ion-optical lens and prior to entering an ion trap. It is desirable to alter the kinetic energy of LDI and MALDI ions since different traps have different requirements in terms of the initial phase space for optimum trapping conditions.

The invention may employ a time-dependent lens potential which increases the potential difference between two successive lens elements progressively with time. It has been found that this can reduce the length over which the position foci are developed (the dispersion in focal lengths discussed above). Heavier ions traversing the lens at greater times may be caused to experience a stronger focusing electrical field. It has been found that the length over which ions with different m/z ratios are focused can be reduced drastically. The invention may also provide such a lens where the focusing strength increases with time to enhance injection efficiency in traps of the heavier ions generated by a source of ions such as a MALDI source.

The present invention preferably relates to improvements in apparatus and methods for enhancing injection of ions in trapping devices by utilizing time-varying ("electrodynamic") electric fields (e.g. electrical potentials). More specifically, it preferably relates to methods and apparatus for generating time-dependent potentials in vacuum lens electrodes to control the kinetic energy distribution across preferably the entire mass range of ions transported from an ion source to an ion trap mass analyzer. In particular, ions with different ratios of mass-to-charge experience different potential distributions as they travel through the vacuum lens at different times. Therefore, by altering the strength of the electric potential, each mass-to-charge ratio can be accelerated/decelerated to the desired kinetic energy level. This allows for controlling the phase space distribution of ions at the entrance of a trapping device, extending the injected mass range and enhancing sensitivity. Preferred embodiments are disclosed including laser desorption/ionization sources coupled to ion traps, and also radio-frequency ion traps serving as ion sources for injection in a second trapping device.

The invention may provide an improved method for enhancing the sensitivity of trapping devices coupled to high vacuum MALDI and LDI sources. The method may utilize time-dependent potentials generated in ion optical elements of a lens system to control the wide kinetic energy of ions developed as a result of the common velocity distribution across the entire mass range.

The invention may be used to extend the mass range stored in trapping devices coupled to vacuum MALDI and LDI sources by adjusting the kinetic energy of the laser desorbed species and controlling the angular spread of the ions beam prior to injection in a trapping device using time-dependent potentials generated in elements of the ion-optical lenses operated under high vacuum conditions.

In the present invention, electrostatic fields generated by applying static voltages to lens electrodes, commonly employed to direct and focus LDI and MALDI ions under high vacuum conditions in ion traps, are replaced by electrodynamic fields. The time-dependent electrical potentials may preferably be selected/designed to modify the kinetic energy of the ions as a function of mass-to-charge (m/z) ratio. This new method has been found to improve sensitivity and extend the mass range introduced into trapping devices.

The invention may be used to control the kinetic energy of ions ejected from a first trapping device and directed toward a second trapping device using ion-optical lenses in which time-dependent potentials are generated, and to enhance injection efficiency and sensitivity accordingly. Control of the angular divergence of an ion beam is desirable in that a single focal distance can be generated, independent of mass-to-charge, and that focal distance can be made to coincide with the entrance slit or injection hole of a trapping device.

In a first of its aspects, the invention may provide a mass spectrometer comprising: ion pulse means for producing ion pulses in a first vacuum chamber; ion trap means for receiving and trapping the ion pulses for mass analysis in a second vacuum chamber; ion-optical lens means arranged between the ion pulse means and the ion trap means for receiving said ion pulses and outputting ions therefrom to the ion trap means, comprising a first lens electrode and a second lens electrode collectively defining (e.g. forming) an optical axis of the ion-optical lens means and adapted for distributing a respective first electrical potential and second electrical potential therealong; lens control means arranged to vary with time (most preferably in a temporally non-periodic variation) the first electrical potential relative to the second electrical potential to control as a function of ion mass-to-charge ratio the kinetic energy of ions (e.g. preferably ions of all masses within the pulse) which have traversed the ion optical lens means thereby to control the mass range of the ions receivable by the ion trap from the ion optical lens means. The time variation of the first electrical potential may be done according to the kinetic energy of ions within an ion pulse received by the ion-optical lens means. The time variation may directly control ions of a pulse traversing the lens means during the variation of the electrical potential, and also may be timed to leave uninfluenced other ions of that pulse traversing the lens, or parts of the lens at other selected times (e.g. by pausing the time variation selectively).

Accordingly, a time-varying electrical potential difference may be produced between the first and second lens electrodes which establishes a time-varying axial potential gradient (electric field E, volts/meter) able to apply a force to accelerate or decelerate ions traversing along the optical axis from one to the other of the first and second lens electrodes. The magnitude, and possibly direction, of the potential gradient at a given location and instant in time is determined according to the instantaneous spatial distribution of the electrical potential at that location. The geometry of the first and second lens electrodes responsible for generating the first and second electrical potentials plays a role. Accordingly, the same region of the ion-optical lens may present different potential gradients to different ions from an ion pulse containing ions of a variety of velocities. Ions travelling at different speeds, or entering the ion-optical lens at different times, will reach the time-varying potential gradient at different times and so be accelerated/decelerated differently to other ions from the pulse. By an appropriate choice of time-variation of the first electrical potential, a wide range of kinetic energies of ions in the pulse can be controlled. The value of the first electrical potential may be ramped in time.

The manner, rate, or profile of the time-variation may be selected according to the particular characteristics of the pulse means and the characteristics of the ion pulses it produces. This selection may be based on prior knowledge or expectation of the distribution of kinetic energies of ions within an ion pulse, by theoretical simulation of that or by empirical trial and error calibration of the mass spectrometer to optimize the time-variation to produce the desired results. A suitably programmed control computer may implement this.

The lens control means may be arranged to vary with time the second electrical potential according to the first electrical potential. By time-varying both electrical potentials, greater rates of change of potential gradient may be achieved and/or greater versatility in the nature of the change. Alternatively, the second electrical potential may be held static.

The lens control means is preferably arranged to vary with time the first electrical potential and/or the second electrical potential (or third—see below) according to the time-of-flight of ions through the lens or first lens electrode, or according to the distribution of arrival times thereat, of the received ions as a function of the mass-to-charge ratio thereof, and/or to control the distribution of the focal distances of ions output by the ion optical lens as a function of the mass-to-charge ratio thereof. Knowledge of the distribution of ion arrival times, or times-of-flight, may be used to design/shape the temporal change of the electrical potential.

The lens control means is preferably arranged to vary the magnitude of the first electrical potential and/or said second electrical potential non-periodically with time, e.g. monotonically with time. The lens control means may be arranged to vary an aforesaid electrical potential in time according to modulation factor described by a linear, logarithmic, exponential, or a polynomial function of time.

The lens control means may be arranged to apply to the first lens electrode a time-varying first electrical voltage and the first lens electrode is preferably arranged to spatially distribute the first electrical potential along the optical axis of the ion-optical lens according to the first electrical voltage. Thus, a simple voltage signal may be used to generate the time-varying electrical potential. Furthermore, the lens control means may be arranged to apply to the second lens electrode a time-varying second electrical voltage and the second lens electrode is preferably arranged to spatially distribute the second electrical potential along the optical axis of the ion-optical lens according to the second electrical voltage.

The first lens electrode may be arranged to distribute a spatially uniform first electrical potential along at least a part of the optical axis of the ion-optical lens. The second lens electrode may be arranged to distribute a spatially uniform second electrical potential along at least a part of the optical axis of the ion-optical lens.

For example, the first and/or second electrical potentials may desirably be provided to not have a potential gradient except at those regions of the optical axis bridging the first and second lens electrodes. The result is that away from the bridging region, an ion may traverse the lens electrode substantially free from acceleration due to potential gradients. This may be desirable to allow ions entering the ion-optical lens at different times and speeds to dwell within the lens desired lengths of time. Alternatively, it may be desired that a potential gradient is generated along much or all of the axis of a lens electrode. This may be achieved by appropriate strengths of potential difference, or by appropriate electrode geometries—transverse dimension or length or both to enable the electrical potential field from one electrode to spill in to an adjacent electrode and combine with it to produce a potential gradient malleable by appropriate time-variation of one or both of the contributing electrical potentials.

For example, the first lens electrode may be positioned adjacent the second lens electrode along the optical axis of the ion-optical lens means to permit the first and second electrical potentials to combine to form a combined electrical potential defining a time-varying potential gradient at parts of the optical axis bridging the first and second lens electrodes.

The ion-optical lens means may comprises a third lens electrode collectively with said first and second lens electrodes forming an optical axis of the ion-optical lens means and adapted for distributing a respective third electrical potential therealong. The lens control means may be arranged to vary with time said third electrical potential. As a result, the ion-optical lens may provide two separate regions of time-varying electrical potential gradient which may apply accelerating/decelerating forces to traversing ions at spaced locations, and optionally in opposite senses/directions if desired. For example, the region bridging the first two of the three lens electrodes may be controlled to variably accelerate ions initially, and the region bridging the last two lens electrodes may be controlled to variably decelerate ions finally (or vice versa). Depending on the selected electrode geometry, the intermediate electrode may be driven by a time-varying voltage to present an electrical potential which varies with time while the other two electrodes may be driven by respective voltages which are static/constant in time so to present respective electrical potentials which vary in regions bridging to the intermediate electrode only by virtue of the time-varying potential there. Alternatively, the intermediate electrode may be driven by a static voltage while one or both of the other two electrodes may be driven by respective voltages which are varying in time so that the intermediate electrode presents an electrical potential which varies in respective regions bridging to the outer two electrodes only by virtue of the time-varying potentials there.

The third lens electrode may be positioned adjacent one of the first lens electrode and the second lens electrode along the optical axis of the ion-optical lens means to permit the third electrical potential and one of the first electrical potential and the second electrical potential to combine to form a combined electrical potential defining a time-varying potential gradient at parts of the optical axis bridging the third lens electrode and one of the first and second lens electrodes. The third lens electrode may be arranged to distribute a spatially substantially uniform third electrical potential along at least a part of the optical axis of the ion-optical lens.

The lens control means may be arranged to hold static with time the respective electrical potentials distributed by one or more of the lens electrodes. Alternatively, or additionally, the lens control means may be arranged to vary with time the respective electrical potentials distributed by two or more said lens electrodes.

The lens control means may be arranged to vary with time the second electrical potential applied to the second lens electrode according to the distribution of ion arrival times at, or times of flight through, the ion-optical lens or the (first, second or third) lens element, as a function of ion mass-to-charge ratio of the received ions thereby to control the distribution of the kinetic energies of ions output by the ion optical lens as a function of the mass-to-charge ratio thereof. The lens control means may also be arranged concurrently to vary with time the first, second or third electrical potential applied to the first, second or third lens electrode to control the distribution of the focal distances of ions output by the ion optical lens as a function of the mass-to-charge ratio thereof.

The second lens electrode may be aligned relative to the first lens electrode for receiving ions from the first lens electrode and for outputting received ions to the ion trap means. The first lens electrode may be aligned relative to the second lens electrode for receiving ions from the second lens electrode and for outputting received ions to the ion trap means.

The third lens electrode may be aligned relative to either of the first lens electrode and the second lens electrode for:

- receiving ions therefrom for outputting received ions to the ion trap means, or;

- receiving ions from the ion pulse means for outputting received ions to the first lens electrode or the second lens electrode, or;

- receiving ions from one of the first lens electrode and the second lens electrode, and directing the received ions to the other of first lens electrode and the second lens electrode.

The ion pulse means may be a pulsed ionization source for generating ion pulses by an ionization process. For example, the pulsed ionization source may be a laser desorption ionization source, including a matrix assisted laser desorption ionization source. The mass spectrometer may be arranged to control the ion pulse means to apply a time delay between ion formation and application of acceleration forces to the ions thereby to form the ion pulse.

Alternatively, the ion pulse means may be a pulsed ion source for outputting pulses of ions stored therein. The ion pulse means may be an RF ion trap arranged to use gas to cool said ions via collisions. The ion pulse means may be incorporated as a part of said ion-optical lens means.

The trap means may be arranged for separating ions of the ion pulses according to ion mass-to-charge ratio. The trap means may be a trap means selected from: a RF ion trap, a 3D quadrupole ion trap, a linear ion trap, an ion cyclotron resonance cell or an orbitrap.

The ion-optical lens may include a terminal immersion lens aligned with the lens electrode(s) along the optical axis of the ion-optical lens means thereby defining the outlet of the ion-optical lens. A lens electrode described above may be comprised of an immersion lens, or an Einzel lens, or an electric sector field, or a combination thereof.

The lens control means may be arranged to supply a lens electrode with a time-varying voltage from which the time-varying electrical potential is generated. The lens control means may be arranged to vary any aforesaid electrical potential in time according to modulation factor described by a linear, logarithmic, exponential, or a polynomial function of time. The lens control means may be arranged to vary an aforesaid electrical potential with a time rate of change having a value from: 1 V/μs to 500 V/μs, or from 5 V/μs to 250 V/μs, or from 10 V/μs to 100 V/μs (Volts per microsecond).

The ion-optical lens means may be located (e.g. in a vacuum chamber) between the first vacuum chamber and the second vacuum chamber. The ion-optical lens means may include an optical axis which is partly or wholly curved, or partly or wholly straight.

It will be understood that the above mass spectrometer describes a realization of a corresponding method of mass spectroscopy which is encompassed by the invention.

For example, in a second of its aspects, the invention may provide a method of mass spectrometry comprising: producing ion pulses in a first vacuum chamber; trapping said ion pulses in an ion trap means for mass analysis in a second vacuum chamber; providing an ion-optical lens means between the ion pulse means and the ion trap means and therewith receiving said ion pulses and outputting ions therefrom to said ion trap means, wherein the ion-optical lens means comprises a first lens electrode and a second lens electrode collectively defining (e.g. forming) an optical axis of the ion-optical lens means along which a respective first electrical potential and second electrical potential are distributed thereby; controlling said first electrical potential to vary (preferably non-periodcally) with time relative to said second electrical potential to control as a function of ion mass-to-charge ratio the kinetic energy of ions which have traversed the ion optical lens thereby controlling the mass range of said ions receivable by said ion trap from said ion optical lens means.

The method may include varying with time said second electrical potential according to the first electrical potential.

The method may include varying with time the first electrical potential and/or the second electrical potential according to the time of flight of received ions through the first lens electrode or the distribution of arrival times of received ions at the ion-optical lens or first or second lens electrode, or ion time-of-flight therethrough as a function of ion mass-to-charge ratio. The method may include varying with time said first electrical potential and/or said second electrical potential in this way to control the distribution of the focal distances of ions output by the ion optical lens as a function of the mass-to-charge ratio thereof.

The method may include varying the magnitude of said first electrical potential and/or said second electrical potential non-periodically with time.

The method may include varying the magnitude of said first electrical potential and/or said second electrical potential monotonically with time.

The method may include distributing said first electrical potential and/or said second electrical potential substantially spatially uniformly in a direction along said optical axis.

The method may include applying to said first lens electrode a time-varying electrical voltage and spatially distributing said first electrical potential along the optical axis of the ion-optical lens means according to said time-varying voltage.

The method may include applying to said second lens electrode a time-varying second electrical voltage and spatially distributing said second electrical potential along the optical axis of the ion-optical lens according to said second electrical voltage.

The method may include using the first lend electrode to distribute a spatially uniform said first electrical potential along at least a part of the optical axis of the ion-optical lens.

The method may include using said second lens electrode to distribute a spatially uniform said second electrical potential along at least a part of the optical axis of the ion-optical lens.

The method may include providing said first lens electrode adjacent said second lens electrode along the optical axis of the ion-optical lens means and combining said first and second electrical potentials to form a combined electrical potential defining a time-varying electrical potential gradient at parts of the optical axis bridging the first and second lens electrodes.

The method may include providing a third lens electrode collectively with said first and second lens electrodes forming an optical axis of the ion-optical lens means and therealong distributing a respective third electrical potential.

The method may include varying with time the third electrical potential. The third lens electrode may be arranged to distribute a substantially spatially uniform third electrical potential along at least a part of the optical axis of the ion-optical lens.

The method may include providing the third lens electrode adjacent one of the first lens electrode and the second lens electrode along the optical axis of the ion-optical lens means and combining the third electrical potential and one of said first electrical potential and the second electrical potential to form a combined electrical potential defining a time-varying potential gradient at parts of the optical axis bridging the third lens electrode and one of the first and second lens electrodes.

The method may include varying with time the respective electrical potentials distributed by two or more said lens electrodes.

The method may include holding static with time the respective electrical potentials distributed by one or more said lens electrodes The method may include varying with time the second electrical potential applied to the second lens electrode according to the distribution of arrival times to, or times-of-flight through, the ion-optical lens or the first, second or third lens element as a function of mass-to-charge ratio to control the distribution of the kinetic energies of ions output by the ion optical lens as a function of the mass-to-charge ratio thereof, and varying with time said first electrical potential applied to the first lens electrode to control the distribution of the focal distances of ions output by the ion optical lens as a function of the mass-to-charge ratio thereof.

The method may include receiving at the second lens electrode ions from said first lens electrode and outputting received ions to said ion trap means.

The method may include receiving at the first lens electrode ions from said second lens electrode and outputting received ions to said ion trap means.

The method may include:

receiving ions from the third lens electrode and outputting received ions to said ion trap means, or;

receiving at the third lens electrode ions from the ion pulse means and outputting received ions to said first lens electrode or said second lens electrode, or;

receiving ions at the third lens electrode from one of the first lens electrode and the second lens electrode, and directing the received ions to the other of first lens electrode and the second lens electrode.

The method may include producing said ion pulses using a pulsed ionization source for generating ion pulses by an ionization process. In the method the pulsed ionization source may be a laser desorption ionization source, including a matrix assisted laser desorption ionization source. The method may include applying a time delay between ion formation and application of acceleration forces to said ions in the ion pulse means thereby to form a said ion pulse.

The method may include producing said ion pulses using a pulsed ion source for outputting pulses of ions stored therein. The method may include producing said ion pulses using an RF ion trap and therein using gas to cool said ions via collisions.

The method may include separating ions of said ion pulses according to ion mass-to-charge ratio using said ion trap means.

The method may include varying a said electrical potential in time according to modulation factor described by a linear, logarithmic, exponential, or a polynomial function of time.

According to any aspect of the invention, the rate of change of applied voltage (and/or electrical potential within a lens electrode) may vary at a rate selected from the range: 5 V per microsecond (5 V/μs) to 250 V per microsecond (250 V/μs); e.g. between 5 V/μs and 100 V/μs, or e.g. between 25 V/μs and 75 V/μs (e.g. about 50 V/μs.

Non-limiting examples of the invention shall now be described with reference to the accompanying drawings of which:

FIG. 1 illustrates a kinetic energy distribution of ions within an ion pulse formed by matrix-assisted laser desorption ionization;

FIGS. 2(*a*), 2(*b*) and 2(*c*) illustrate an ion optical lens coupled to a laser desorption ionization source and the spatial distribution of a time-varying electrical potential established throughout the ion-optical lens thereof [FIG. 2(*a*)], the time-variation of the magnitude of the voltage applied to the ion-optical lens [FIG. 2(*b*)], and the kinetic energy distributions of ions within an ion pulse having traversed the ion-optical lens [FIG. 3(*c*)];

FIGS. 3(*a*), 3(*b*) and 3(*c*) illustrate an ion optical lens coupled to a laser desorption ionization source nd the spatial distribution of a time-varying electrical potential established throughout the ion-optical lens thereof [FIG. 3(*a*)], the time-variation of the magnitude of the voltage applied to the ion-optical lens [FIG. 3(*b*)], and the focal distances of ions within an ion pulse having traversed the ion-optical lens [FIG. 3(*c*)];

FIGS. 4(*a*), 4(*b*), 4(*c*) and 4(*d*) each illustrate a series of preferred geometries of ion-optical lenses of the present invention, the potential distribution along the ion optical axes of the lenses and the time-varying voltages applied to particular electrodes of each of the ion-optical lenses thereof, FIG. 5 illustrates a mass spectrometer comprising a LDI source, an ion-optical lens and a Fourier-transform ion cyclotron resonance analyzer and the potential distribution along the ion-optical axis of the entire system established by the application of a time-varying voltage to an electrode of the ion-optical lens thereof;

FIG. 6 illustrates a mass spectrometer comprising a LDI source, a lens and a linear ion trap and two preferred potential distributions along the ion-optical axis of the entire system established by the application of time-varying voltages to lens electrodes at different regions of the lens;

FIGS. 7(*a*), 7(*b*) and 7(*c*) illustrate the orbitrap mass spectrometer [FIG. 7(*a*)], the ejection scheme of a delayed extraction LDI source [FIG. 7(*b*)] and the time-varying voltage applied to the inner electrode of the orbitrap [FIG. 7(*c*)];

In the drawings, like articles are assigned like reference symbols.

Figure 1:
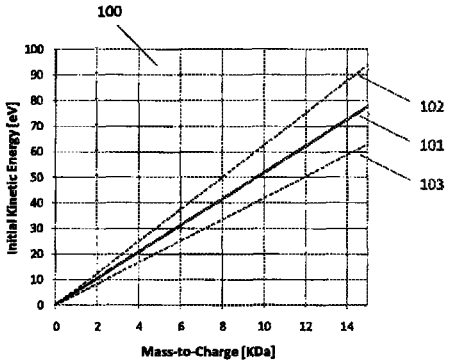

FIG. 1 shows a typical kinetic energy distribution of MALDI ions as a function of mass-to-charge ratio ("m/z" hereafter) (100). Both ion kinetic energy and the kinetic energy spread scale linearly with m/z. In this example the kinetic energy increases approximately by 5 eV/KDa assuming 1000 $ms^{-1}$ initial ion velocity independent of m/z (101). The kinetic energy spread of the ions scales linearly with m/z also (101, 102). For a velocity spread of +/−100 $ms^{-1}$, the corresponding kinetic energy spread increases from ~2 eV for 1 KDa ions to ~20 eV for 10 KDa ions. The kinetic energy distribution remains wide at the end of an electrostatic ion-optical system employed for ion injection in a trapping device and can severely limit the performance in terms of the injected mass range and the sensitivity. Therefore, it is desirable to control the ion kinetic energy over the entire mass range of interest and prior to injection in a trapping device.

Figure 2:
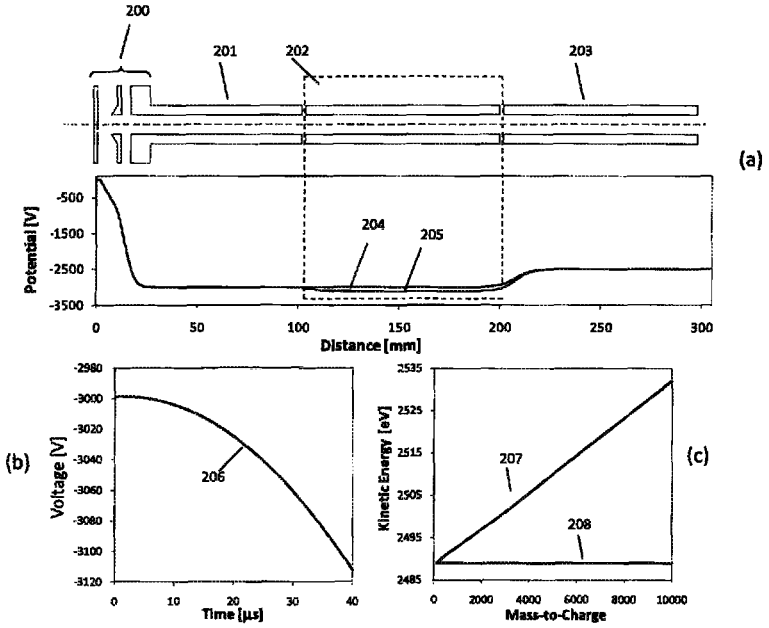

A first embodiment of a lens geometry coupled to a vacuum MALDI source is shown schematically in FIG. 2. Here it is demonstrated that at least one time-dependent voltage applied by a lens control means (not shown) to a lens electrode can be used to control the kinetic energy of the ions at the exit of the system. In this embodiment of a lens geometry the laser desorption ionization source is comprised of a gridless two-stage acceleration region (200) coupled to an ion-optical lens consisting of three axially symmetric lens electrodes (201, 202 and 203) which may comprise, for example, cylindrical lens electrodes. In the electrostatic mode of operation, the voltages applied to a first two consecutive lens electrodes (201 and 202) are maintained at the same value. The voltage applied to the third lens electrode (203) is fixed forming an "immersion lens" to control the angular divergence of the ion beam and establishing a position focus downstream the optical axis.

The potential distribution along the axis of symmetry is shown graphically (204). In the electrostatic mode of operation, the corresponding kinetic energy across a wide range of m/z values at the exit of the lens system is also shown graphically (207). The kinetic energy increases approximately by 4 eV/KDa. In contrast, in the electrodynamic mode of operation the voltage applied to the second (202) of the first two consecutive lens electrodes (201, 202) is varied with time in the manner shown graphically in FIG. 2(*b*) at (206) in order to generate electrical potential gradients along the regions of the optical axis of the ion-optical lens bridging the first and second lens electrodes (201, 202) and the second and third lens electrodes (202, 203). These potential gradients remove the excess kinetic energy of the heavier ions and generate a monoenergetic ion beam at the exit of the lens. The effect of reducing the voltage applied to the second lens electrode (202) from −3000 to −3100 V in a quasi-exponential fashion within 40 μs (206) is shown in FIG. 2(*c*) graphically (208) where the ion kinetic energy is constant throughout the range of m/z values ("iso-energetic"). The starting (204) and final (205) axial electrical potential distributions are also shown. As the electrical potential difference between the second and third electrodes (202 and 203) is gradually increased, the heavier ions within the ion pulse traversing the ion-optical lens lose an additional amount of kinetic energy, which is proportional to the time rate of change of the voltage (206) applied to the second lens electrode (202). The time profile of the applied voltage (206) can be modified or optimized accordingly to generate the desired kinetic energy dependence over the range of m/z.

Figure 3:
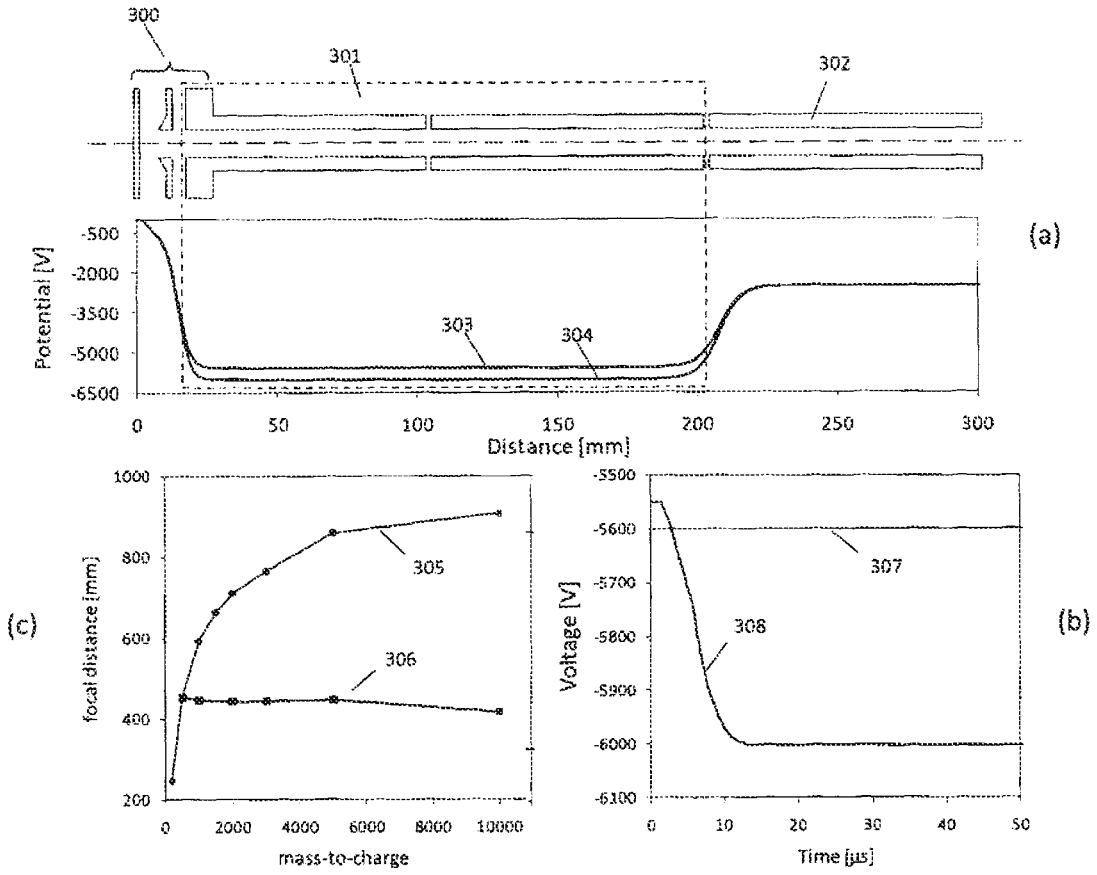

In another embodiment of the invention where time-dependent voltages are applied to enhance injection in trapping devices, it is desirable to control the angular divergence of the ion beam. FIG. 3(*a*) shows the same laser desorption ionization source (300) as employed in the embodiment of FIG. 2. Ions are accelerated by a series of three lens electrodes to reach their final kinetic energies at the exit of the lens system defined by the third and final lens electrode (302). Ion optics simulations indicate that acceleration of ions having a common initial velocity distribution using the appropriately time-varying electrical voltage (308) shown in FIG. 3(*b*) applied in common and in tandem to each of the pair of successive first and second lens electrodes (301) results in a distribution (305) of the positions of focal points along the optical axis at which ions come to a focus, as shown in FIG. 3(*c*). The distribution of the positions of ion focal points tend to vary according to the m/z ration of the ions being focused. This can impose severe limitations to the mass range introduced into a trapping device and consequently sensitivity since the injection hole is usually restricted to 1 mm or less to minimize the fringe fields.

The method disclosed presently may overcome this problem as shown in FIG. 3(*c*), for example by utilizing a time-dependent voltage (308) applied to two consecutive lens electrodes (301) in an ion-optical lens comprising a final third lens electrode held at a different static voltage. The lens electrodes are controlled by a lens control means (not shown) as described below. The electrical potential distribution (303, 304) along the optical axis of the ion-optical lens at the beginning (303) and at the end (304) of the application of the time-dependent voltage is also shown. Increasing the voltage applied to the pair of electrodes (301) at a rate of 50V/μs has a significant impact on the performance of the lens. The distribution of the focal points on the optical axis is minimized as shown by FIG. 3(*c*) (see curve 306). Ions can be effectively transmitted through a narrow hole, or slit, defining the ion input entrance of an ion trap, by employing the methods illustrated by this embodiment. In particular, the apparatus illustrated and described in this embodiment has been found able to achieve this with mimimal ion losses in respect of such an ion inlet hole, of typical dimensions, positioned at 450 mm from the ion outlet end of the ion-optical lens.

The present invention may provide ion-optical geometries where both the kinetic energy as well as the position of focal points across desirably the entire range of interest are controlled simultaneously to optimize injection efficiency and enhance sensitivity by utilizing time-dependent potential applied to lens electrodes operated under high vacuum conditions.

Figure 4:
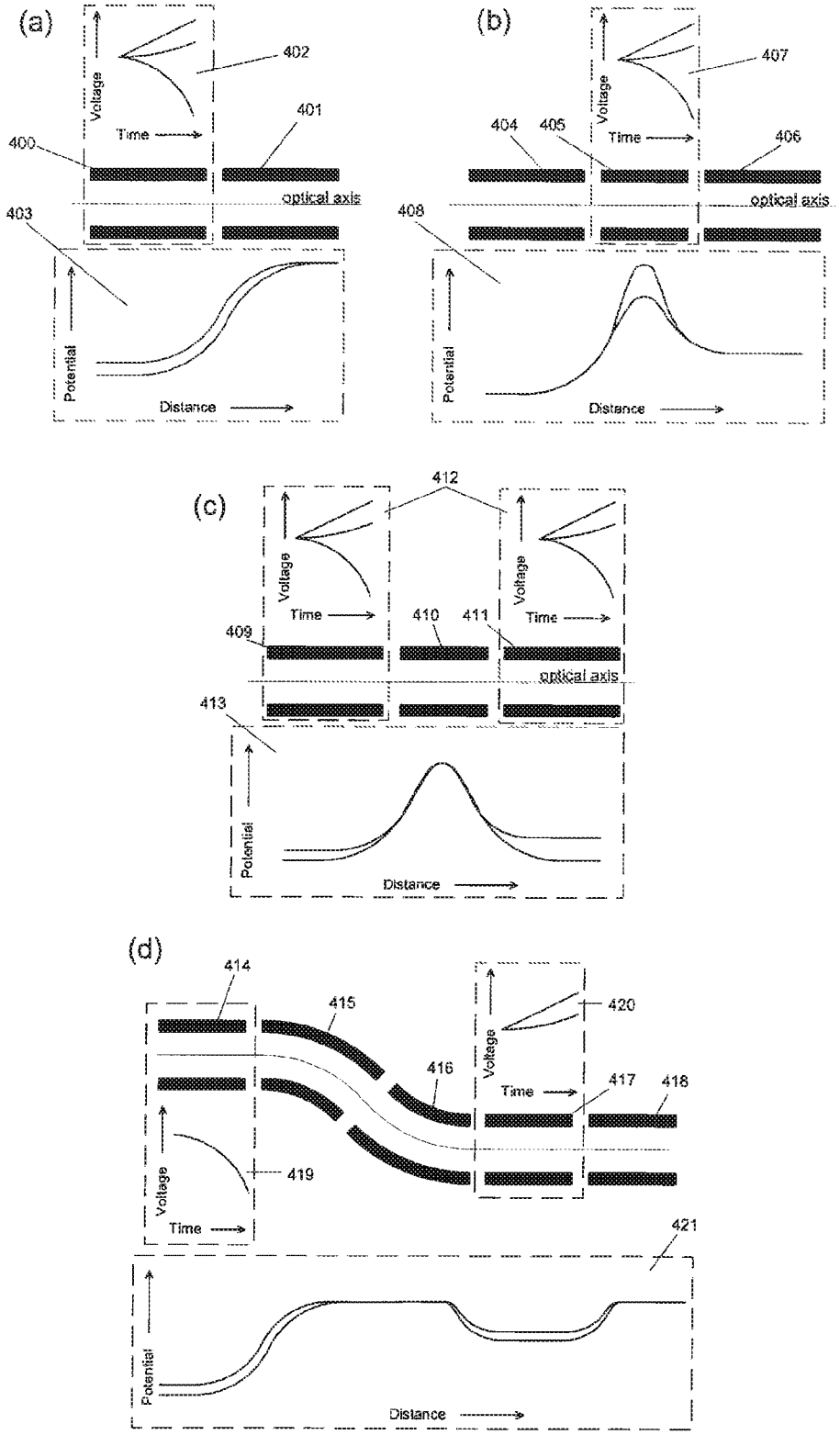

FIG. 4 shows lens geometries employing time-dependent voltages controlled by a control means (not shown) to modify the kinetic energy of ions as a function of m/z ratio. FIG. 3(*a*) shows an immersion lens comprised of two lens electrodes (400 and 401) to which voltages are applied to produce electrical potentials along the respective lens electrodes to decelerate positively charged ions as they move from left to right. The voltage applied to a first lens electrode (400) is varied with time to progressively change the electrical potential distributed by it and thus the potential difference established between the first lens electrode and a second axially successive lens electrode (401) hald at a constant voltage. A potential gradiant (403) is established along the region of the optical axis bridging the first (400) and second (401) lens electrodes. The time profile of the time-varying voltage potential applied to the first lens electrode (400) can have any desired non-periodic form (402), according to the required phase space distribution of ions as a function of m/z. Two electrical potential distributions along the optical axis of the ion-optical lens are shown (403) to depict the change in the potential energy ions experience as they traverse the lens at different times. FIG. 3(*b*) is another preferred embodiment of the present invention where three consecutive lens electrodes (404, 405 and 406) are arranged with a common optical axis and are supplied with appropriate voltage potentials to form an Einzel lens.

The voltage potentials applied to the entrance and exit lens electrodes (404 and 406 respectively) differ. The voltage potential applied to the intermediate lens electrode (405) is varied with time in any suitable non-periodic manner as schematically illustrates (407) to control both the kinetic energy of the ions as a function of m/z at the exit of the lens as well as the position focus of each m/z. Two snapshots of the potential distribution along the optical axis at different times are also shown (408). FIG. 3(*c*) shows another embodiment of the invention where an Einzel lens comprised of three lens electrodes (409, 410 and 411) is supplied with more than one time-dependent voltage potential to generate more than one time-varying electrical potential along more than one lens electrode of the ion-optical lens. The forms of the voltage potentials varying with time and applied to electrodes (409 and 411) can be adjusted independently (412) by control means (not shown). Here again, snapshots of the electrical potential distribution along the optical axis at two different times are shown (413). FIG. 3(*d*) is yet another embodiment of the invention where the lens geometry has a curved path. The lens is comprised of five lens electrodes (414-418). Electrodes (415 and 416) form two sector fields in S configuration. The voltage potential applied to a first lens electrode (414) is reduced with time (419) and the corresponding electrical potential difference established between the first and second lens electrodes (414 and 415) defines a potential gradient which is selected to eliminate the dependence of ion kinetic energy on m/z and introduce ions into the sector field having a common axial kinetic energy.

All ions are then transmitted through the tandem electrostatic sector and enter the second segmented of the lens supplied with another time-dependent voltage potential. In this case, the voltage potential (420) applied to a penultimate lens electrode (417) increases with time, reducing the electrical potential difference between the penultimate and ultimate lens electrodes (417 and 418). As a result, heavier ions traverse this part of the ion-optical lens at greater/later times and exit the ion-optical lens to arrive at the entrance of an ion trapping device (not shown) with greater kinetic energy. Snapshots of the electrical potential profile along the ion optical axis at two different times are also shown (421).

Figure 5:
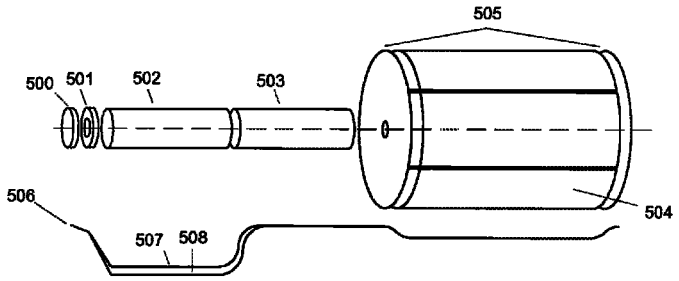

FIG. 5 shows a high vacuum LDI source (500) followed by a series of ion-optical lenses (501, 502 and 503) to direct ions into an ICR cell (504). The potential across the optical axis is also shown (506). In this embodiment of a time-dependently driven ion-optical lens coupled to a mass analyzer, ions undergo two-stage acceleration prior to entering a lens electrode of the ion-optical lens supplied with the time-dependent voltage potential (502). The electrical potential difference between consecutive lens electrodes (502 and 503) of the ion-optical lens determines the energy that ions traversing the lens will lose prior to entering the cell. Lighter ions traverse the lens while the potential difference between the two lens electrodes (502 and 503) remains relatively low (507). Similarly to the example described with reference to FIG. 2, the absolute value of the voltage potential applied to the first of the two consecutive lens electrodes (502) is gradually reduced and the heavier ions arriving at later times experience a greater electrical potential drop (508 in the region bridging electrodes 502 and 503). The reduction of the potential with time removes the excess initial kinetic energy of the heavier ions ascribed by the desorption/ionization event. All ions are injected into the cell with a common kinetic energy along the axial direction. A weak voltage applied to the two end-cap electrodes of the cell (505) becomes then sufficient for trapping a wide mass range efficiently. A weak axial trapping field is highly desirable for minimizing field distortions within the cell and enhancing mass resolving power.

Figure 6:
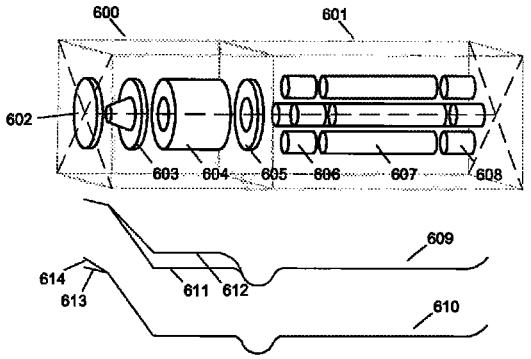

In another preferred embodiment of a lens supplied with a time-dependent voltage potential and coupled to a LDI source and a trapping device, it is desirable to increase the kinetic energy of the heavier ions to extend the injected mass range. A schematic diagram is shown in FIG. 6 where the laser desorption/ionization source is located in a first vacuum chamber (600) and the RF linear ion trap in a second vacuum chamber (601) preferably maintained at an elevated pressure with respect to the first chamber. Ions are desorbed and ionized on top of the target plate (602), transported through the lens system comprised of a focusing lens (603) and an electrodynamic lens (604), and finally introduced into the ion trap (606-608), through a ring electrode (605) establishing an Einzel lens. During the filling time, the ion trap electrodes (606 and 607) are maintained at a uniform voltage potential (no RF-drive applied) and ions are prevented from passing through the trap by a reflecting electrical potential applied at the rear end of the device (608).

The arrival time difference between ions with different ratios of m/z imposes a limitation to the range introduced into the trap since flight times for heavier ions can be greater than the residence time of the lighter ions, which in turn is determined by their kinetic energy and the strength of the reflecting field inside the trap. The application of the RF-drive stores essentially all ions present within the trapping volume while rejects those still approaching. In practice, the arrival time difference between ions with different ratios of m/z can be reduced significantly by accelerating heavier ions to energies sufficiently high to eliminate their time lag. Therefore, the range of m/z present within the trapping volume and prior to the application of the RF-drive can be enhanced considerably.

The excessive energy of the heavier ions can be removed via collisions with buffer gas particles. Two possible electrical potential distributions are presented (609 and 610). In the first distribution (609), ions are accelerated by the two-stage field established between electrodes 602-604. The voltage applied to the electrode (604) is progressively increased, (611 to 612), and heavier ions traversing this part of the lens at greater times acquire greater kinetic energies. Similarly, in another variation of a lens supplied with at least one time dependent voltage, ions spending more time in the first region of the lens acquire greater energies as the voltage applied to the back plate (613) is progressively increased (614).

Figure 7:
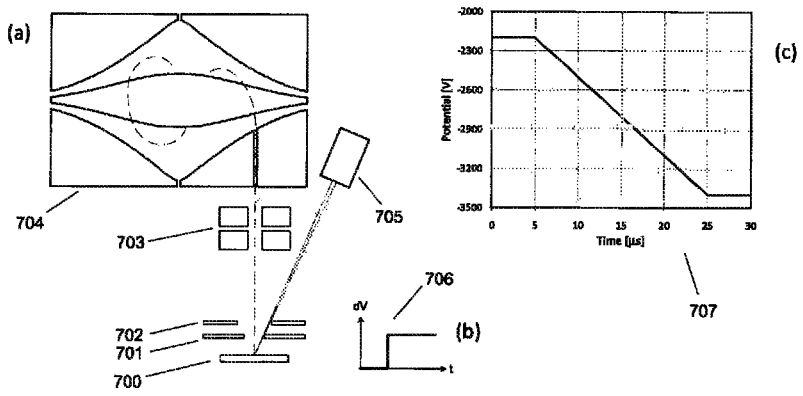

FIG. 7 shows yet another preferred embodiment where a LDI source is coupled to the orbitrap mass analyzer (704) through a high vacuum lens (700-703) for direct ion injection. Ions are generated on top of the target plate (700) by a laser pulse (705) and accelerated by establishing potential differences between electrodes (700-701 and 701-702) toward a subsequent vacuum lens (703) supplied with a time-dependent voltage. It is also desirable to introduce a time delay between ion formation and acceleration to reduce the degree of fragmentation usually observed with LDI sources operated under prompt acceleration conditions. This is achieved by maintaining the potential difference dV between two electrodes (700 and 701) at zero and applying the extraction pulse (706) within a few hundreds of ns.

In the conventional method of injection of ions into the orbitrap [Makarov A, Anal. Chem. 2000, 72, 1156; Hu Q. et al, J. Mass Spectrom. 2005, 40, 430] the voltage applied to the trap's central electrode is ramped at a rate of ~50 V/μs and ions experience a monotonic increase in electric field strength established between inner and outer electrodes (707) inside the trap. The process is termed "electrodynamic squeezing" during which ions are forced to the optimum orbiting trajectory by the ramping field. The method enhances sensitivity only for ions with sufficient kinetic energy to survive the first few orbits by preventing losses on the outer electrode. This increasingly stronger electric field precludes all heavier ions from being trapped successfully since their kinetic energy is lower to that required for developing stable trajectories. The upper to lower ratio of m/z injected succesfully is restricted to 20:1.

In this preferred embodiment shown in FIG. 7 an immersion-type lens is established by providing the lens electrodes (703) with appropriate time-dependent voltages. Heavier ions traversing the lens at later times will be injected with a greater kinetic energy into the orbitrap (704) by progressively adjusting the potential difference between the two lens electrodes. For an accelerating immersion lens heavier ions are provided with greater kinetic energy by increasing the potential difference established between the electrodes. In contrast, for a decelerating immersion lens the potential difference must be reduced over time. Other types of lenses can be used to enhance injection efficiency and extend the injected mass range according to the preferred embodiments disclosed in the present invention. The rate of change of the voltage applied to the lens electrodes used for controlling ion kinetic energy is of the same order to that supplied to inner orbitrap electrode. In other embodiments in which the ion-optical lens is coupled to an LDI source and an orbitrap mass analyzer, the rate of change of applied voltage (and electrical potential) can vary from 5 V per microsecond (5 V/μs) to 250 V per microsecond (250 V/μs) depending on the kinetic energy of the ions entering the lens and also the dimensions of the region where the time-varying potential is established.

Figure 8:
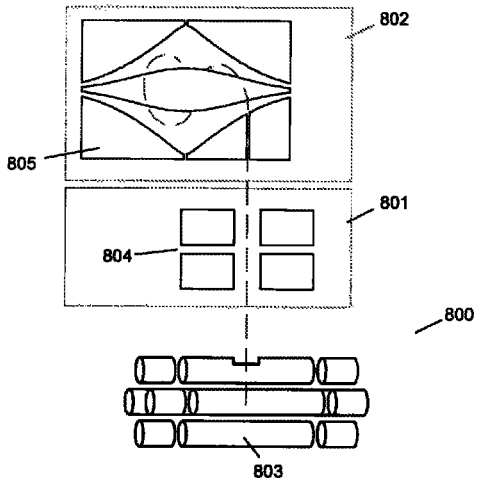
FIG. 8 illustrates the orbitrap mass spectrometer including a pulsed ion source comprising an RF ion trap and an electrodynamic lens located between the orbitrap and the RF ion trap.

In yet another preferred embodiment shown in FIG. 8, the orbitrap mass analyzer (805) is coupled to a RF ion trap (803), both mounted on separate compartments (800 and 802) and operated at different pressure. The electrodynamic lens 804 is disposed in a separate vacuum compartment (801) and in this example is comprised of two electrodes only. Ions ejected from the RF trap experience a time dependent potential developed between the lens electrodes. Preferably, the potential difference increases at a time rate to match the voltage ramp applied to the inner electrode of the orbitrap, that is, ~50 V/μs. Ions having greater ratios of m/z enter the mass analyzer with sufficient kinetic energy to acquire stable trajectories. Other vacuum ports not shown in FIG. 8 can be disposed between compartments (800-801, and, 801-802).

Figure 9:
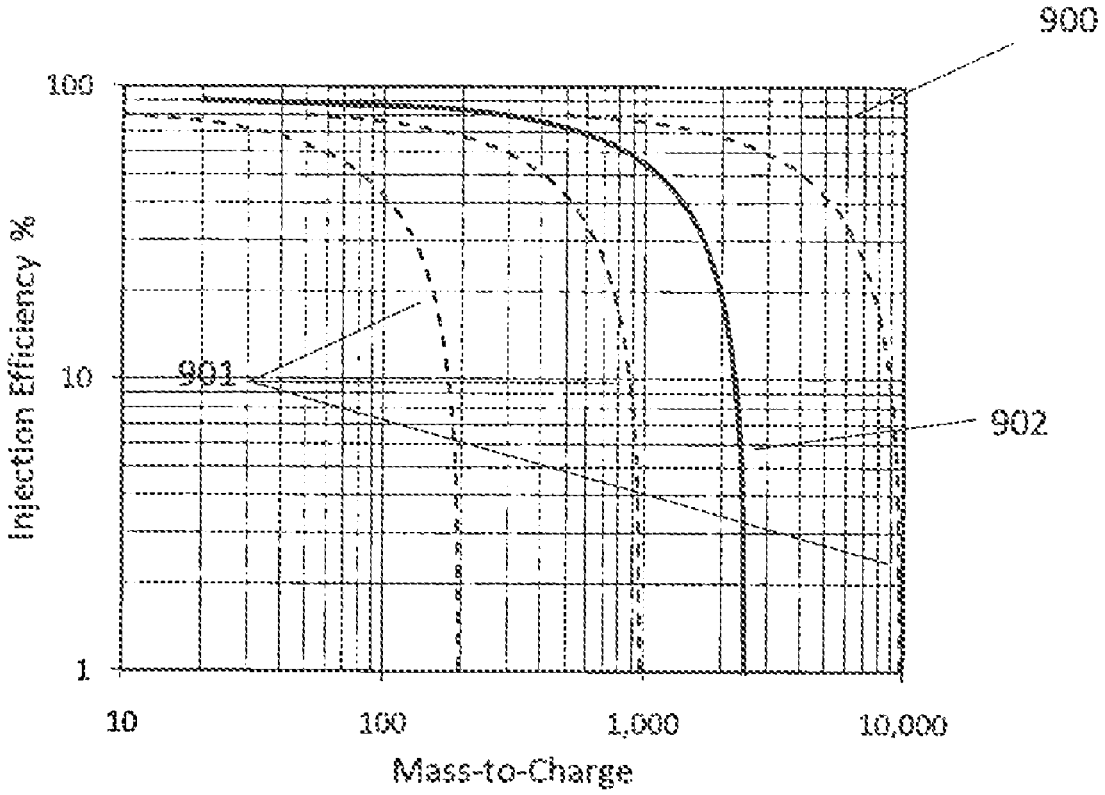
FIG. 9 illustrates injection efficiencies in the orbitrap mass analyzer according to mass-to-charge ratios.

FIG. 9 shows injection efficiency of ions into the orbitrap across the mass range (900). In the conventional method of operation using electrostatic fields for directing ions through the injection hole the upper-to-lower m/z ratio is restricted to 20:1 (901). The use of lens electrodes supplied with time-dependent potential to adjust ion kinetic energy enhances injection efficiency by extending the mass range to preferably to 40:1 or most preferably to ~100:1 (902) and also improving transmission efficiency into the orbitrap.

The above examples are intended for illustration only and are non-limiting. Variations and modifications to aspects of the examples such as would be readily apparent to the skilled person are encompassed within the scope of the invention as defined by the claims for example.

The invention claimed is:

1. A mass spectrometer comprising:

ion pulse means for producing ion pulses in a first vacuum chamber, at least one of said pulses comprising a plurality of ions of differing mass-to-charge ratio and differing kinetic energy;

ion trap means for receiving and trapping said ion pulses for mass analysis in a second vacuum chamber;

ion-optical lens means arranged between the ion pulse means and the ion trap means for receiving said at least one of said pulses which retain said plurality of ions of differing mass-to-charge ratio and differing kinetic energy, and outputting ions therefrom to said ion trap means, comprising a first lens electrode and a second lens electrode collectively defining an optical axis of the ion-optical lens means and adapted for distributing a respective first electrical potential and second electrical potential therealong;

lens control means arranged to vary non-periodically with time said first electrical potential relative to said second electrical potential to control as a function of ion mass-to-charge ratio the kinetic energy of ions which have traversed the ion optical lens means thereby to control the mass range of said ions receivable by said ion trap from said ion optical lens means.

2. A mass spectrometer according to claim 1 in which the lens control means is arranged to vary with time said second electrical potential according to the first electrical potential.

3. A mass spectrometer according to claim 1 in which said lens control means is arranged to vary with time said first electrical potential and/or said second electrical potential according to the distribution of arrival times of said received ions at said ion-optical lens means, or lens electrode thereof, or time-of-flight therethrough, means as a function of ion mass-to-charge ratio to control the distribution of the focal distances of ions output by the ion optical lens as a function of the mass-to-charge ratio thereof.

4. A mass spectrometer according to claim 1 claim in which said ion-optical lens means comprises a third lens electrode collectively with said first and second lens electrodes forming an optical axis of the ion-optical lens means and adapted for distributing a respective third electrical potential therealong.

5. A mass spectrometer according to claim 4 in which lens control means arranged to vary with time said third electrical potential.

6. A mass spectrometer according to claim 1 claim in which the lens control means is arranged to vary a said electrical potential with a time rate of change having a value from: 1 V/μs to 500 V/μs, or from 5 V/μs to 250 V/μs, or from 10 V/μs to 100 V/μs (Volts per microsecond).

7. A mass spectrometer according to claim 4 in which the third lens electrode is aligned relative to either of the first lens electrode and the second lens electrode for:

(a) receiving ions therefrom for outputting received ions to said ion trap means, or;

(b) receiving ions from the ion pulse means for outputting received ions to said first lens electrode or the second lens electrode, or;

(c) receiving ions from one of the first lens electrode and the second lens electrode, and directing the received ions to the other of first lens electrode and the second lens electrode.

8. A mass spectrometer according to claim 1 in which the ion pulse means is a pulsed ionization source for generating ion pulses by an ionization process.

9. A mass spectrometer according to claim 1 arranged to control the ion pulse means to apply a time delay between ion formation and application of acceleration forces to said ions thereby to form a said ion pulse.

10. A mass spectrometer according to claim 1 in which the ion-optical lens includes a terminal immersion lens aligned with said lens electrode(s) along the optical axis of the ion-optical lens means thereby defining the outlet of the ion-optical lens.

11. A mass spectrometer according to claim 1 wherein a said lens electrode is comprised of an immersion lens, or an Einzel lens, or an electric sector field, or a combination thereof.

12. A mass spectrometer according to claim 1 wherein said trap means is a trap means selected from: a RF ion trap, a 3D quadrupole ion trap, a linear ion trap, an ion cyclotron resonance cell or an orbitrap.

13. A mass spectrometer of claim 12 wherein said ion pulse means is an RF ion trap arranged to use gas to cool said ions via collisions.

14. A method of mass spectrometry comprising:

producing ion pulses in a first vacuum chamber using an ion pulse means, at least one of said pulses comprising a plurality of ions of differing mass-to-charge ratio and differing kinetic energy;

trapping said ion pulses in an ion trap means for mass analysis in a second vacuum chamber;

providing an ion-optical lens means between the ion pulse means and the ion trap means and therewith receiving said at least one of said pulses which retain said plurality of ions of differing mass-to-charge ratio and differing kinetic energy, and outputting ions therefrom to said ion trap means, wherein the ion-optical lens means comprises a first lens electrode and a second lens electrode collectively defining an optical axis of the ion-optical lens means along which a respective first electrical potential and second electrical potential are distributed thereby;

controlling said first electrical potential to vary non-periodically with time relative to said second electrical potential to control as a function of ion mass-to-charge ratio the kinetic energy of ions which have traversed the ion optical lens thereby controlling the mass range of said ions receivable by said ion trap from said ion optical lens means.

15. A method according to claim 14 including varying with time said second electrical potential according to the first electrical potential.

16. A mass spectrometer according to claim 1 in which the third lens electrode is aligned relative to either of the first lens electrode and the second lens electrode for:

(a) receiving ions therefrom for outputting received ions to said ion trap means, or;

(b) receiving ions from the ion pulse means for outputting received ions to said first lens electrode or the second lens electrode, or;

(c) receiving ions from one of the first lens electrode and the second lens electrode, and directing the received ions to the other of first lens electrode and the second lens electrode.

17. A mass spectrometer comprising:

an ion pulse generator for producing ion pulses in a first vacuum chamber, at least one of said pulses comprising a plurality of ions of differing mass-to-charge ratio and differing kinetic energy;

an ion trap capable of receiving and trapping said ion pulses for mass analysis in a second vacuum chamber;

an ion-optical lens arranged between the ion pulse generator and the ion trap, said ion-optical lens being capable of receiving said at least one of said pulses which retain said plurality of ions of differing mass-to-charge ratio and differing kinetic energy, and outputting ions therefrom to said ion trap, said ion-optical lens comprising a first lens electrode and a second lens electrode collectively defining an optical axis of the ion-optical lens and adapted for distributing a respective first electrical potential and second electrical potential therealong;

a lens controller arranged to vary non-periodically with time said first electrical potential relative to said second electrical potential to control as a function of ion mass-to-charge ratio the kinetic energy of ions which have traversed the ion optical lens thereby to control the mass range of said ions receivable by said ion trap from said ion optical lens.

18. A mass spectrometer according to claim 17 in which the lens controller is arranged to vary with time said second electrical potential according to the first electrical potential.

19. A mass spectrometer according to claim 17 in which said lens controller is arranged to vary with time said first electrical potential and/or said second electrical potential according to the distribution of arrival times of said received ions at said ion-optical lens, or lens electrode thereof, or time-of-flight therethrough, as a function of ion mass-to-charge ratio to control the distribution of the focal distances of ions output by the ion optical lens as a function of the mass-to-charge ratio thereof.

20. A mass spectrometer according to claim 17 in which said ion-optical lens comprises a third lens electrode collectively with said first and second lens electrodes forming an optical axis of the ion-optical lens and adapted for distributing a respective third electrical potential therealong.

21. A mass spectrometer according to claim 20 in which said lens controller is arranged to vary with time said third electrical potential.

22. A mass spectrometer according to claim 17 in which the lens controller is arranged to vary a said electrical potential with a time rate of change having a value from: 1 V/μs to 500 V/μs, or from 5 V/μs to 250 V/μs, or from 10 V/μs to 100 V/μs (Volts per microsecond).

23. A mass spectrometer according to claim 20 in which the third lens electrode is aligned relative to either of the first lens electrode and the second lens electrode for:

(a) receiving ions therefrom for outputting received ions to said ion trap, or;

(b) receiving ions from the ion pulse generator for outputting received ions to said first lens electrode or the second lens electrode, or;

(c) receiving ions from one of the first lens electrode and the second lens electrode, and directing the received ions to the other of first lens electrode and the second lens electrode.

24. A mass spectrometer according to claim 17 in which the third lens electrode is aligned relative to either of the first lens electrode and the second lens electrode for:

(a) receiving ions therefrom for outputting received ions to said ion trap, or;

(b) receiving ions from the ion pulse generator for outputting received ions to said first lens electrode or the second lens electrode, or;

(c) receiving ions from one of the first lens electrode and the second lens electrode, and directing the received ions to the other of first lens electrode and the second lens electrode.

25. A mass spectrometer according to claim 17 in which the ion pulse generator is a pulsed ionization source for generating ion pulses by an ionization process.

26. A mass spectrometer according to claim 17 arranged to control the ion pulse generator to apply a time delay between ion formation and application of acceleration forces to said ions thereby to form a said ion pulse.

27. A mass spectrometer according to claim 17 in which the ion-optical lens includes a terminal immersion lens aligned with said lens electrode(s) along the optical axis of the ion-optical lens thereby defining the outlet of the ion-optical lens.

28. A mass spectrometer according to claim 17 wherein a said lens electrode is comprised of an immersion lens, or an Einzel lens, or an electric sector field, or a combination thereof.

29. A mass spectrometer according to claim 17 wherein said ion trap is selected from: a RF ion trap, a 3D quadrupole ion trap, a linear ion trap, an ion cyclotron resonance cell or an orbitrap.

30. A mass spectrometer of claim 29 wherein said ion pulse generator is an RF ion trap arranged to use gas to cool said ions via collisions.

31. A method of mass spectrometry comprising:

producing ion pulses in a first vacuum chamber using an ion pulse generator, at least one of said pulses comprising a plurality of ions of differing mass-to-charge ratio and differing kinetic energy;

trapping said ion pulses in an ion trap for mass analysis in a second vacuum chamber;

providing an ion-optical lens between the ion pulse generator and the ion trap and therewith receiving said at least one of said pulses which retain said plurality of ions of differing mass-to-charge ratio and differing kinetic energy, and outputting ions therefrom to said ion trap, wherein the ion-optical lens comprises a first lens electrode and a second lens electrode collectively defining an optical axis of the ion-optical lens along which a respective first electrical potential and second electrical potential are distributed thereby;

controlling said first electrical potential to vary non-periodically with time relative to said second electrical potential to control as a function of ion mass-to-charge ratio the kinetic energy of ions which have traversed the ion optical lens thereby controlling the mass range of said ions receivable by said ion trap from said ion optical lens.

32. A method according to claim 31 including varying with time said second electrical potential according to the first electrical potential.

* * * * *